United States Patent [19]

Svensson

[11] 4,155,384

[45] May 22, 1979

[54] DISK TYPE WOOD CHIPPER

[75] Inventor: Nils D. Svensson, Hammarö, Sweden

[73] Assignee: Aktiebolaget Iggesunds Bruk, Sweden

[21] Appl. No.: 862,320

[22] Filed: Dec. 20, 1977

[30] Foreign Application Priority Data

Dec. 31, 1976 [SE] Sweden ..... 7700014

[51] Int. Cl.[2] ..... B27C 1/00; B02C 18/18

[52] U.S. Cl. ..... 144/176; 144/163; 144/218; 144/323; 241/92; 241/298

[58] Field of Search ..... 241/292.1, 92, 91, 296, 241/298, 278 R; 144/162 R, 163, 172, 176, 218, 230, 326 A, 326 B, 326 C, 326 D, 323

[56] References Cited

U.S. PATENT DOCUMENTS

| | | | |
|---|---|---|---|
| 2,710,635 | 6/1955 | Alexander | 144/162 R |
| 3,032,281 | 5/1962 | Wexell | 241/92 |
| 3,542,302 | 11/1970 | Salzmann, Jr. | 144/176 X |
| 4,047,670 | 9/1977 | Svensson | 144/176 X |

*Primary Examiner*—Donald R. Schran
*Assistant Examiner*—W. D. Bray
*Attorney, Agent, or Firm*—Dowell & Dowell

[57] ABSTRACT

A disk type wood chipper having cutter knives disposed non-radially on a chipper disk to cut a slab of wood from a log and having guide means with ridges over which such slab is caused to slide so that the slab disintegrates into wood chips of substantially uniform size.

10 Claims, 8 Drawing Figures

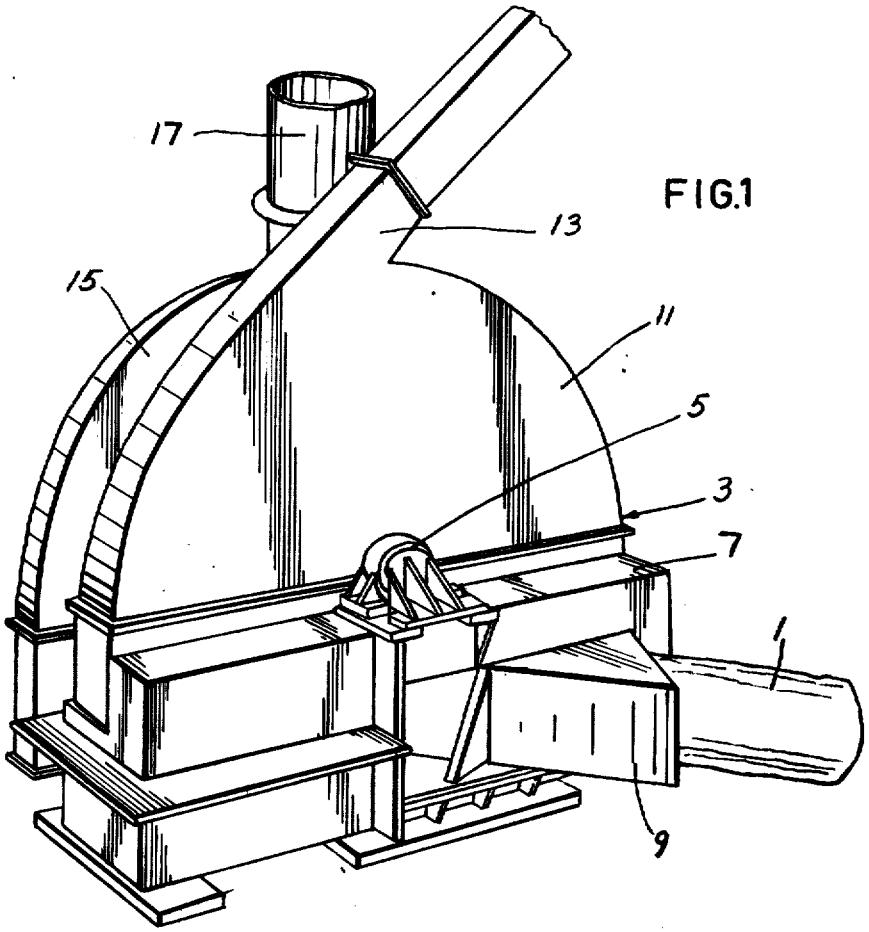
FIG.1
FIG.4
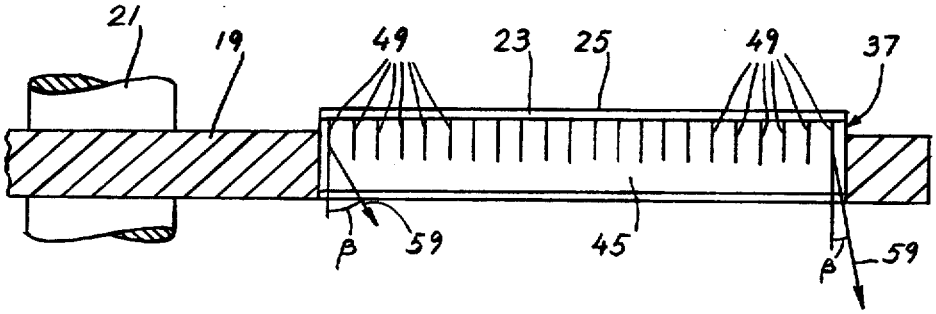

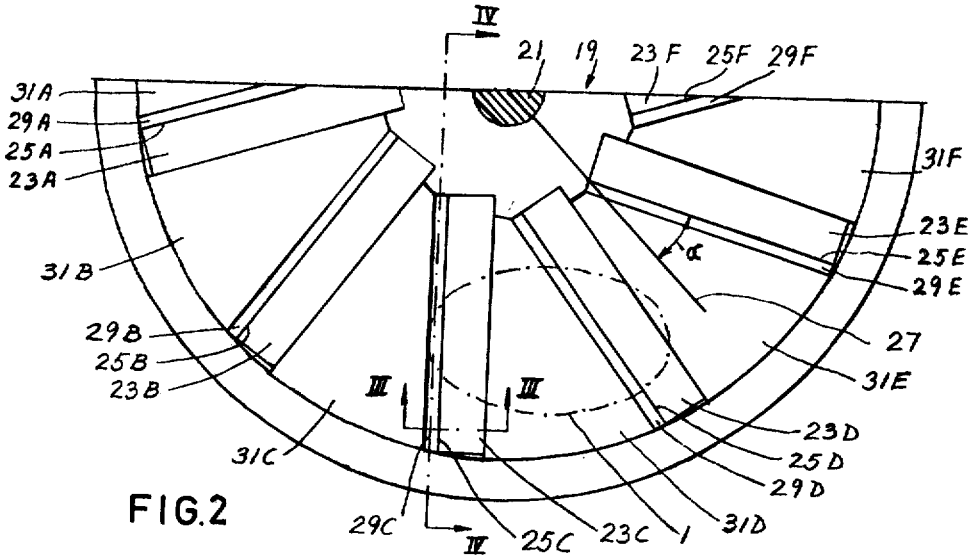
FIG.2
FIG.3
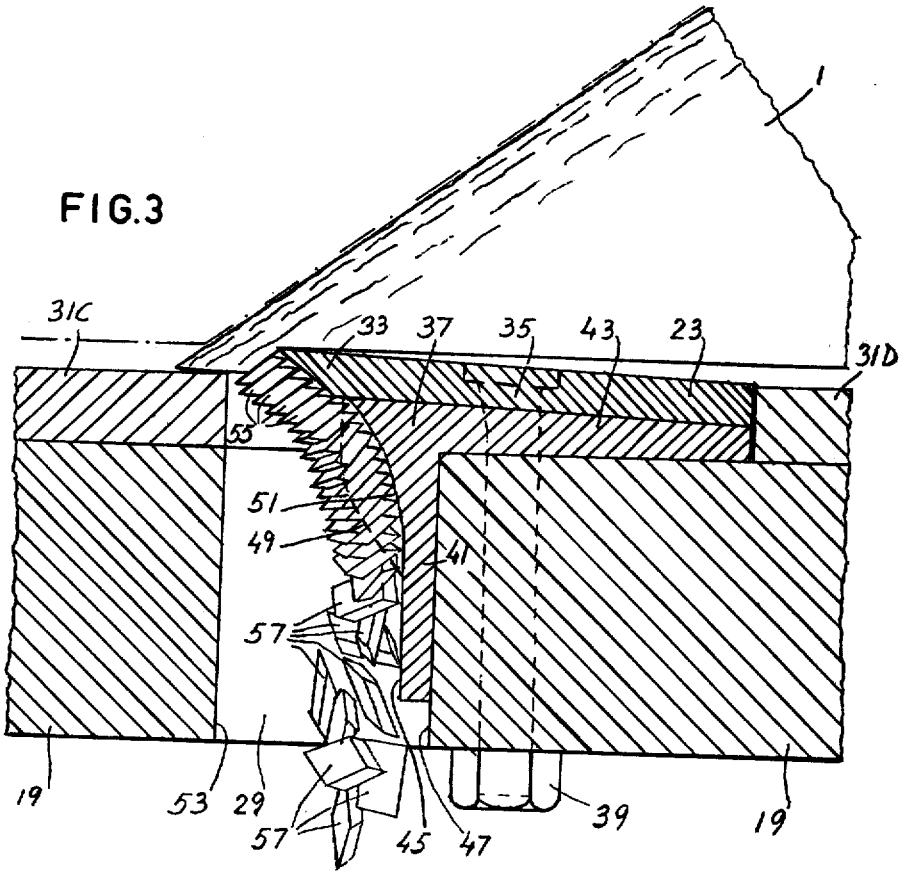

DISK TYPE WOOD CHIPPER

The present invention relates to wood chipping machines of the disc type including a circular rotatable chipper disc drivably connected at its center to a drive shaft, said chipper disc along one of its axially facing sides being provided with a plurality of elongated cutter knives, disposed in a rotationally symmetrical configuration and extending in outward direction towards the periphery of the disc from a central zone of the disc and in addition having one guiding surface each located in immediate connection to an associated knife so as to cause a chip slab cut off from a log by any of the knives to strike, and slide along, the guiding surface immediately after having left the knife.

Wood chipping machines of the type in consideration are known already from e.g. The U.S. Pat. Nos. 2,570,845 and 3,032,281 and The Swedish printed Patent Application No. 323,872. Under favourable conditions these machines are capable of operating quite satisfactorily. When the separated chip slab strikes, and slides along, the guiding surface it is broken up laterally into small chips.

This disintegration is effected haphazardly along the natural cracks in the wood, and as a normal consequence a share of oversized chips with a breadth that may reach 0.3 meters will be obtained and, in addition, about 5 percent of undersized chips (dust and pin chips), which are not suited as raw material for pulp production in a digester, but constitute a wood loss. In some cases the share of oversized chips of dry coniferous wood can amount to from about 15 to 20 percent. With careful chipping the wood losses can be reduced by half, but the share of oversized chips will then increase by approximately a further 5 percent. These oversized chips must be reduced by repeated chipping prior to digestion and, as from about 30 to 40 percent of dust and slivers usually result from this reducer chipping, the wood loss will increase to still higher values.

For the purpose of disintegrating the chip slabs laterally into chips of intended breadth, it has been suggested already to keep the cutter knives short, their length thus have equal to the desired breadth of the chip pieces. Further, it has been suggested to mount an incising means ahead of each knife to cut grooves in the log prior to the entry of the chipper knife and thus to create fractural impressions where the chip slabs are intended to be disintegrated into chips of predetermined size. It has also been suggested that in wood chippers of the drum type, as described in the U.S. Pat. No. 2,710,635, for example, the guiding surface adjacent each knife should be designed with a plurality of razor-sharp ridges parallel to each other and extending in substantially radially inward direction towards the axis of rotation of the chipper drum. This construction is intended to force the chip slab cut off from the log by the cutter knife against the sharp ridges by change of direction and to become disintegrated into chips of predetermined uniform breadth. It has proved, however, that all these suggestions for solution of the problem are unsatisfactory, as they afford a marginal effect only. The chip slab splits at the natural cracks also, so that a relatively large proportion of oversized chips and an increased share of pin chips will still be obtained.

In order to reduce the ratio of oversized chips, it is also usual to provide a chipbreaker on the rear side of the chipper disc. This breaker is similar to the pins of a shredder and is designed to break up the oversized chips. However, this expedient produces an even larger share of pin chips and an increased dust content, which results in high wood losses.

Therefore, one main object of the present invention is to provide a device adapted to reduce the share of oversized chips produced in the chipping of pulpwood in chippers of the disc type and to produce chips of a higher quality than those obtained from drum type chippers, said device moreover being less exposed to breakdowns.

This object is obtained, according to one main feature of the invention, by, each guiding surface including a plurality of ridges extending side by side in a direction away from the knives and disposed so as to cause the chip slabs to slide across the ridges to be broken up laterally into digester chips of substantially uniform size, and that substantially each ridge has a longitudinal direction forming an acute angle of at most about half a radian with the direction of travel of the chip slabs when sliding on the ridges. As the chip slab will slide obliquely across the ridges while being accelerated to the velocity of the disc and is pressed hard up against the ridges by the force of acceleration, the weakest points of the slab will be found in the vicinity of that series of points where the bending moment produced by the forcing of the slab against the ribs is a maximum, so that the force of acceleration will break up the slab at its weakest points. Thus, if there are natural cracks in the wood, disintegration will take place first and foremost in these cracks, but any rupture in the vicinity of natural cracks will not occur when using the device according to the invention, and the share of oversized chips will be reduced considerably without any increase in the share of undersized chips.

Most suitably the angle between the direction of sliding of the chip slab and the longitudinal direction of the ridges is greatest nearest the shaft axis and decreases towatds the periphery of the chipper disc, said angle adjacent the axis preferably amounting to about 0.5 radians at the utmost and adjacent the periphery to at least about 0.15 radian. As the pressure of the slab against the ridges is greatest at the periphery of the disc and diminishes towards the disc centre, this variation in angle will result in that the scanning of the weakest points of the slab will be effected over a larger area when the loading pressure is lower.

In order to produce the desired sliding movement, it is suitable to form, in a similar manner as is previously practized in horizontal chippers and some spout chippers, each knife with a cutting edge, the longitudinal extension of which forms an acute angle less than about 0.7 radian, preferably about 0.5 radian, with a radius that extends from the axis of the chipper disc and through the point on the cutting edge located nearest said axis. In this way the ridges can run in parallel to one another at a relative spacing of double the desired chip breadth, and their longitudinal direction projected onto a plane along the cutting edge laid transversely to the plane of rotation of the chipper disc can become parallel to the axis of rotation of the disc. This facilitates the forming of the ridges in the guiding surface. For example, in cases where the guiding surface is formed on a chip guide of suitable shape fitted between knife and chipper disc, the ridges can be obtained by milling suitably shaped parallel grooves in the chip guide.

It has also proved suitable to shape the ridges with crests rounded in the transverse direction. In this way the bending moment is not concentrated at a particular point, as would be the case with a crest which is sharp in the transverse direction. Instead, the slab is broken up along natural cracks or at other weak places, whereby production of pin chips is reduced.

Preferably the height of the ridges above intermediate dividing grooves or valleys in a portion located nearest the associated knife increases gradually with increased spacing from said knife. This will subject those parts of the slab which abut against the elongate ridge crests to a higher acceleration than the parts that meet the intermediate grooves, so that the pieces of chip produced by the disintegration of the slab will be rolled over during their passage across the guiding surface.

The ridges may suitably have an included angle in the longitudinal direction of between about 2 radians and about 3 radians, depending on the toughness of the wood to be cut into chips, the included angle decreasing with increasing toughness. It is also desirable to increase the height of the ridges with increasing toughness.

It has also proved advantageous at a place located furthest away from the cutter knife to let the height of the ridges above the intermediate dividing grooves gradually decrease to zero with increased spacing from the knife. This measure ensures that all chips take substantially the same direction of travel when they leave the guiding surface.

To make certain that the chips are not pressed together and damaged by compression, it is suitable to impart a concave smooth curvature to the groove between the ridges in the longitudinal direction.

When the chipper disc is formed with an elongate slot located under the cutting edge of each knife to allow the chips to pass through the disc, it is suitable that the spacing between the intermediate grooves and the leading side wall of the slot determined by the direction of rotation of the disc, increases with increased distance from the knife. By this expedient the space for the chips in the slot is widened, so that plugging is avoided.

Further, as regards wear, it is suitable when an elongate chip guide is interposed between each knife and the chipper disc, to support the knife at a predetermined angle to the rotational plane of the disc, to design the ridges in a guiding surface located on a leading side of the guide as determined by the direction of rotation of the chipper disc.

The invention will now be described in more detail with reference to a preferred embodiment illustrated in the accompanying drawings. In these drawings:

FIG. 1 is a perspective view of a wood chipping machine of the disc type, specifically a so-called horizontal chipper apparatus.

FIG. 2 is a front view of the bottom half of the chipper disc included in the horizontal chipper shown in FIG. 1.

FIG. 3 is a cross sectional view following line III—III in FIG. 2 and showing a preferred embodiment of a device according to the invention during operation.

FIG. 4 is a cross-sectional view following line IV—IV in FIG. 2 and showing diagramatically the direction of travel of the chip slab obliquely across the ridges.

Figure 5:
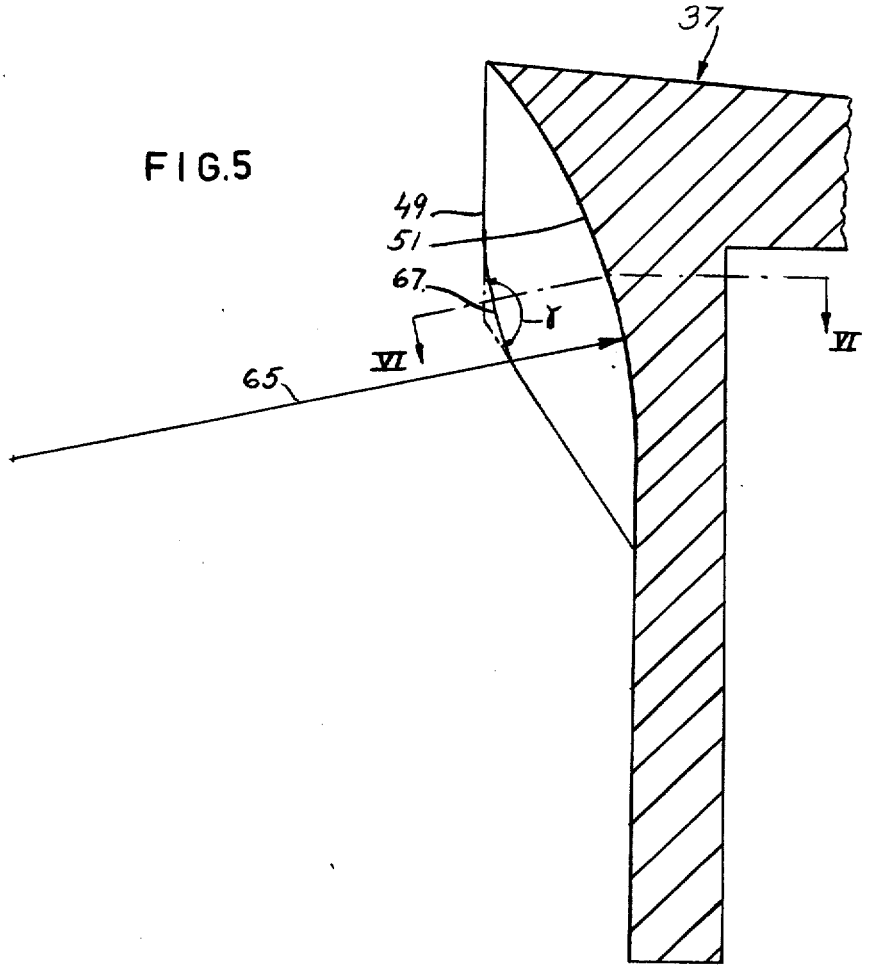
FIG. 5 is a cross-sectional view similar to that presented in FIG. 3, but showing to an enlarged scale and in more detail a chip guide formed with ridges.

Referring now to the drawings, FIG. 1 shows a log 1 under treatment by cutting into chips in a horizontal chipper 3, i.e. a wood chipping machine of the disc type with horizontal feed. The chipper 3 has a chipper disc (not shown in this Figure) provided with peripheral blades and attached to a shaft (also not shown here) which is driven by a suitable motor (also not shown). The shaft is carried in a bearing 5 mounted on a suitable base 7 and otherwise supported in a suitable way. A horizontal feed spout 9 for the log 1 enters at an oblique angle into and extends through the base 7 to the bottom feed side of the chipper disc, where exchangeable holder tools or bed knives (not shown) are arranged. The chipper disc is enclosed coaxially by a protective hood 11, the top of which has a tangential outlet 13, through which the chips are ejected at high velocity by the blades. A flywheel (not shown) is also attached to the shaft and this flywheel is also enclosed by a protective hood denoted by reference numeral 15. Between the hoods 11 and 15 a pipe 17 for return air from a connected chip separating means (not shown) is attached.

Although the invention is being described as adapted to a horizontal chipper of the above stated type, it can quite simply be adapted to other types of horizontal chippers, e.g. by disposing the blades on the flywheel and forming a chip duct to connect the hood 11 with the hood 15 and attaching the tangential chip outlet 13 to the flywheel hood 15. Moreover, the invention can be adapted just as well to so-called drop feed chippers which have a feed spout 9 inclined to the vertical plane.

The chipper disc 19 shown in FIG. 2 is circular and coaxially attached to a drive shaft 21. For this attachment the shaft 21 may have an integrally formed flange, not shown, secured to the rear face of the chipper disc 19 by a plurality, e.g. twenty-four, through-bolts (not shown in FIG. 2). The chipper disc 19 is provided along the feed side, i.e. the front side shown, with a plurality of elongated cutter knives 23—the number of which in the illustrated embodiment is ten, of which six are shown and denoted 23A–24F. These knives 23 are arranged in a rotationally symmetrical configuration and extend in outward direction towards the periphery of the chipper disc from a central zone thereof. In the shown embodiment the knives are fixed along one surface. Each knife 23 has a cutting edge 25, denoted in the embodiment shown as 25A–25F and in the longitudinal direction forming an acute angle $\alpha$, less than about 0.7 radians and preferably about 0.5 radians, with a radius 27 extending from the axis of shaft 21 through the point of the cutting edge 25 located nearest said shaft 21. In the horizontal chipper type, the radially inner portion of the cutting edge 25 usually is located ahead of its radially outer portion, as shown in FIG. 2, whereas for drop feed chippers a contrary position usually is preferred. In both cases, the knives 23 in the chipper operation will press the log 1 (the end face of which is indicated in FIG. 2 as a chain-dotted ellipse) against the said (not shown) bed knives or holder tools. The chipper disc is also formed with elongate slots 29, the number of which is equal to that of the cutter knives and which are positioned axially under each cutting edge 25 in order to allow the chips to pass through the disc 19, and which in the FIG. 2 are designed 29A–29F. In the zone from the rear edge of each knife 23 to the front edge of the next following slot 29 the chipper disc is protected by a wear plate 31, the portions of which visible in FIG. 2 are denoted 31A–31F. The wear plate is bolted or in some other suitable way secured onto the disc. If the chipper disc 19 is to be fitted with blades, these blades can be positioned in those annular peripheral portions of the disc, which, as in the embodiment shown, are not occupied by knives, slots and wear plates. In general the blade equipment may be of the construction disclosed e.g. in the U.S. Pat. No. 3,032,281 referred to above.

FIG. 3 shows that the knife 23, which is fixed along its one surface and which has a bevel front edge forming a cutting edge portion 33, is secured to the chipper disc 19 by means of a plurality of headed bolts 35, the total number of which in the shown embodiment is eight and of which one is indicated by dotted lines. The head of the bolt 35 is sunk into the knife 23 and the shank of the bolt extends from said head through the knife 23, through a chip guide 37 interposed between the knife 23 and the disc 19, and through the disc 19 proper to the back or rear face of the disc where the bolt 35 is secured by a locking nut 39. The chip guide 37, which is also denoted knife support and can be a casting, such as a casting of modular iron, has a front portion 41 constituting the actual chip guiding part, and a rear attachment portion 43, which is wedge-shaped and supports the knife 23 at a predetermined angle to the plane of rotation of the chipper disc 19. The front portion 41 of the chip guide has a guiding surface 45 and extends along, and is supported by, a rear bounding wall 47 of the slot 29 and it may, as shown, terminate at a distance from the rear face of the disc 19 or also extend to become flush with said face. The rear wedge-shaped attachment portion 43 is formed with clearance holes, not shown, for the headed bolts 35 and it may be formed with a plurality of, such as three, tapped holes, also not shown, for separate bolting of the chip guide 37 from the rear face of the disc 19 by means of bolts, also not shown.

The guiding surface 45, which has a basic shape such as substantially to constitute a continuation of the surface of the cutting edge portion 33 facing the slot 29, comprises according to the present invention a plurality of ridges 49 extending side by side in a direction away from the knife 23, one of the ridges being indicated by a dotted line in FIG. 3. The ridges are separated laterally by intermediate grooves or valleys 51, and the spacing from the grooves to a front bounding wall 53 of the slot 29 increases with increased distance from the knife 23 to form an expanding clearance for undisturbed movement of the chips in a direction towards the rear side of the disc 19.

In a chipping operation the knife 23 will cut off one chip slab 55 after the other from the log 1. In principle, the length of each chip slab is determined by the momentary dimension of the log 1 along the line of action of the knife 23, its breadth by the axial distance by which the knife 23 projects from the wear plate 31, and its thickness by the cutting edge angle of the knife 23. The separated chip slabs initially slide along the surface of the cutting edge portion 33 facing the slot 29, and immediately after having left said portion they strike, and slide along, the guiding surface 45 with its ridges 49 and intermediate grooves 51. Although the logs during chipping operation are fed towards the chipper disc at an average speed of about 1 meter per second, the wood is substantially stationary when each individual cut affects a log. When the knife 23 passes through the log 1, the separated chip slabs 55 are accelerated during a very short time interval of about 0.015–about 0.03 secs, to a speed that can exceed 45 meters per second nearest the periphery of the disc 19. This means that the slabs 55 will be forced very strongly against the ridges 49 of the chip guide 37 and are bent down towards the intermediate grooves 51, which results in that the slabs 55 are broken up into digester chips 57 at the weak points that are nearest the deepest parts located between the crest of the ridges 49 and the central portion of the grooves 51. Viewed towards a plane passing across the longitudinal direction of the ridges 49, this disintegration is effected in the ideal case (assuming a slab of uniform strength) exactly over each ridge 49 and exactly over each groove 51. For this reason the ridges are positioned at a relative spacing of approximately twice the desired chip breadth.

As in reality the wood of every chip slab is not homogeneous and the slab exhibits one or several series of weak points, it would be preferable to guide the disintegration so as to be effected at the absolutely weakest points of the slab. According to the present invention, therefore, substantially every ridge has a longitudinal extension—as shown in FIG. 4, where the ridges 49 are indicated diagramatically by straight dashes—that forms an acute angle $\beta$ of maximum about half a radian with the direction of travel 59 of the chip slab as it slides on the ridges 49. As the slab does not slide exactly in the longitudinal direction of the ridges, but obliquely across the same, the weakest points of the slab will be found and disintegration will be effected at these weakest points. FIG. 4 also shows that the longitudinal direction of the ridges 49 projected on a plane along the cutting edge 25 laid transversally to the plane of rotation of the disc 19, is parallel to the shaft 21. The desired oblique sliding of the chip slab over the ridges 49 is produced by the inclined mounting of the knives 23 in relation to a purely radial direction, as is shown in FIG. 2. A chip slab that has just been cut off from the log 1 by any of the knives 23 will try to maintain its position due to the inertia forces acting on the same, so that it is given a tangential component of motion in relation to the rotating knife, which component is greatest nearest the shaft 21 and diminishes in outward direction towards the periphery of the disc 19. This means that the angle $\beta$ will also be greatest adjacent the shaft 21 and diminish in outward direction towards the periphery of the disc. Adjacent the shaft 21 the angle $\beta$ preferably has a maximum value of about 0.5 radians and adjacent the periphery of the disc 19 it is preferably at least about 0.15 radians.

As the relative tangential component of motion is greatest nearest the shaft 21 and diminishes in outward direction towards the periphery of the disc 19, the separated chip slab will be subjected initially to some compression in its longitudinal direction. When the knife 23 moves through the log 1 it has a higher velocity at its radially outer end than at its radially inner end, and therefore the chip slab 55 just cut off will also have a higher velocity at its radially outer end then at its radially inner end, so as to become subjected to some rotation when sliding along the chip guide 37. The initial compression will, therefore, rapidly change over into a tension that actively contributes to the disintegration of the chip slab into digester chips.

Figure 6:
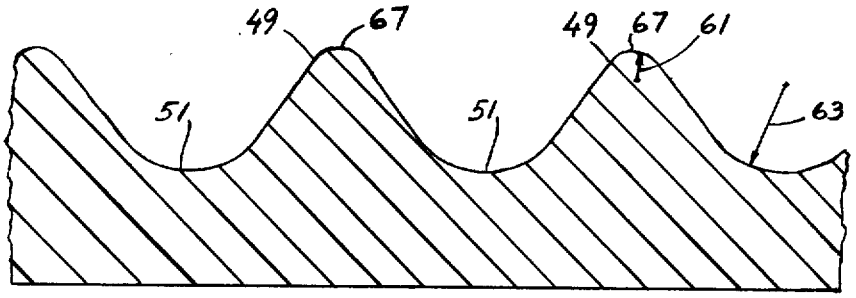
FIG. 6 is a partial longitudinal sectional view following line VI—VI in FIG. 5 and showing a preferred cross-sectional shape of the ridges.

In the preferred embodiment of the chip guide 37 shown in FIGS. 5 and 6, the ridges 49 have rounded crests in the transverse direction and the intermediate grooves 51 also have a rounded profile in the transverse direction. This round configuration is such that the ridge crests have a transverse radius of curvature 61 of about 5 mms, whereas the transverse radius of curvature 63 of the grooves is considerably larger, about 15 mms. These rounded curvatures are preferably constant along the ridges 49 and the grooves 51, whereas the ridges have an included angle, not shown, in the transverse direction that varies gradually from more than 3 radians at the ends of the ridges 49 to more than 1 radian at the highest point of the ridges.

In the longitudinal direction the grooves or valleys 51 have a concave smooth round configuration and the radius of curvature 65 may here be of the order of 0.1 meter. In a portion located nearest the knife the height of the ridges 49 above the grooves 51 increases gradually from zero with increased spacing from the knife, whereas in a portion located furthest away from the knife the height of the ridges 49 over the grooves 51 diminishes gradually to zero with increased spacing from the knife. In the longitudinal direction the ridges 49 have an included angle $\gamma$ of a magnitude between 2 radians and about 3 radians, depending on the toughness of the wood to be cut to chips. The included angle $\gamma$ is to be diminished with increasing toughness.

In their middle portion the ridges 49 have crests 67 that are also rounded in the longitudinal extension of the ridges, and the ridges 49 slope down towards their ends from the rounded crests 67. The slopes towards the ends are suitably straight on both sides of the rounded crests 67, which are preferably located exactly half way between the ends of the ridges 49. A radius of curvature, not shown, for the radius of the rounded profile of the crests 67 in the longitudinal direction of the ridges 49 may be of the same order of magnitude as the distance from the tips of the crests 67 ahead of the round curve to the ends of the ridges 49. However, in some cases it may be advantageous to design the crests 67 in a longitudinal direction with a straight portion, not shown, while simultaneously imparting to the ridges 49 increased length, so as to increase the area for scanning the weakest points of the chip slab.

In the embodiment shown in FIG. 5, the highest point of the ridges 49 in an end portion located nearest the knife is in a plane substantially transversally to the plane of rotation of the chipper disc 19. This structure is in general well suited for dry so-called summer-stored wood. However, this angle should be adapted to the quality of the wood to be cut, and when chipping frozen wood, for example, it is recommended that the crests of the ridges 67 have an advanced setting in the direction of rotation similar to that shown for the ridge crests 167 and 267 in FIGS. 7 and 8, respectively.

Figure 7:
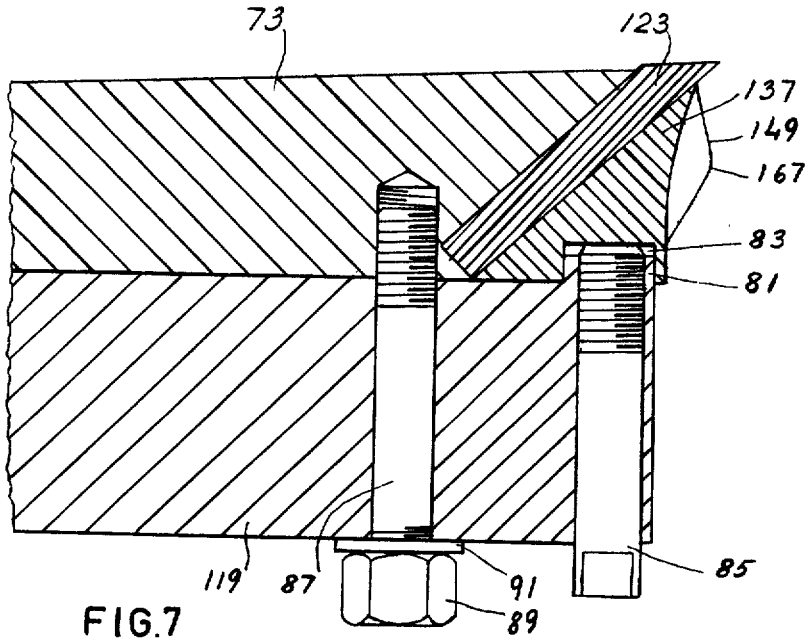
FIGS. 7 and 8 are cross-sectional views similar to that presented in FIG. 3 and showing two alternative knife mountings constituted by chip guides formed with ridges.
Figure 8:
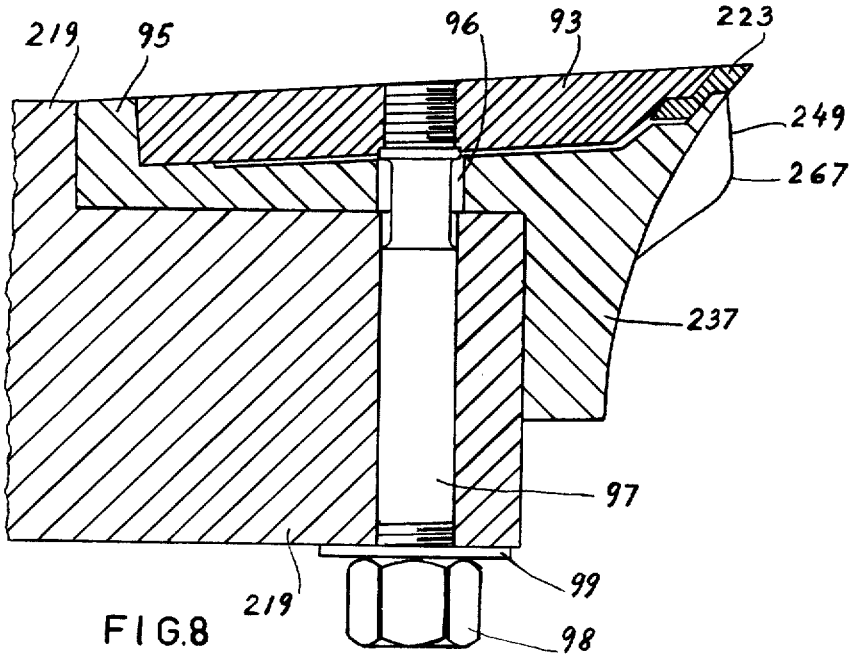

FIGS. 7 and 8 show that the application of the invention is not limited to a chipper disc with knives fixed along one of their surfaces. In the embodiment shown in FIG. 7, a plurality of elongated knives 123, disposed in a rotationally symmetrical configuration and of which one is shown, are mounted between a clamping bar 73 and a chip guide 137 formed with ridges 149. As in the preceding embodiments, the knives 123 have flat parallel faces, but they are securely clamped between an inclined front edge of the clamping bar 73 and an inclined rear edge of the chip guide 137, which, unlike the chip guide 37 shown in FIG. 3, has a substantially triangular cross section. The ridges 149 are shaped and arranged substantially in the same way as described in conjunction with FIGS. 3 to 6. The chipper disc 119 is made with a spigot 81 projecting axially from the front of the disc at the rear edge of each slot, and a groove 83 matching the spigot 81 is formed in that side of the chip guide 137 which is in contact with said disc. A plurality of adjustable studs 85, one of which is shown, extend from the rear face of the chipper disc 119 through tapped holes out through the spigot 81 to make contact with the bottom of the groove 83. The clamping bar 73 is mounted on the chipper disc 119 by means of a plurality of studs 87 screwed into the clamping bar in positions near the rear edge of the knife 123 and extending through the disc 119 to the rear edge thereof, where each stud 87 is secured by a nut 89 and a washer 91.

In the embodiment shown in FIG. 8, the knives 223 are of the indexable type and each knife is securely clamped between a clamping bar 93 and a chip guide 237 of substantially the same basic shape as the chip guide 37 illustrated in FIG. 3. The chip guide 237 is formed with ridges 249 shaped and arranged substantially in the same manner as described in conjunction with FIGS. 3 to 6. The chipper disc 219 shown is not provided with wear plates 31, but instead the chip guide 237 is formed with a hook-shaped rear edge 95 intended to support the clamping bar 93 against the chipping forces and sunk into the chipper disc 219 at the rear edge of each slot. A plurality of studs 97, one of which is shown, are screwed into the clamping bar 93 and extend through holes 96 formed in the wedge-shaped attachment portion 243 of the chip guide 237 and further through the disc 219 to the rear side thereof, where each stud is secured by means of a nut 98 and a washer 99.

The invention is not limited to the preferred embodiments described above and shown in the drawings and presented for the purpose of illustration only, but a plurality of modifications and variations of it are conceivable within the scope of the appended claims. For example, the ridges can be allowed to terminate abruptly without their height above the grooves becoming zero, but it is then suitable that the chips formed by disintegration of the chip slab be allowed to strike the chipper disc at the rear bounding surface of each slot, so that the chips are given a common angle of ejection. If the embodiments shown and described are modified, it must always be ensured that the chipping geometry is maintained such that the chip slabs are made to slide obliquely across the ridges, so that the desired searching or scanning for the weakest points of the slab and disintegration at these points will be obtained. Further, it is also possible to make the chip guide in two parts in such a way that it has a front portion provided with ridges and the intermediate grooves or valleys, and a rear portion which supports the knife. The front portion can then be made of a particularly durable material, such as hard metal, and bolted onto or secured in some other way to the rear portion, which can be a conventional chip guide, provided that this latter has a shape such that the front portion can be attached to the same without difficulty.

The application of the invention has proved to produce excellent results. For example, there were difficulties in chipping wood with a dryness of about 70% in a wood chipper. The share of oversized chips obtained at maximum feed amounted to between 10 and 15 percent. After changing from the conventionally shaped chip guide to the chip guide shown in FIGS. 3 to 6, the share of oversized chips dropped to 4.4 percents, without any increase in the share of undersized chips. The nominally set chip length was 19 mms and the chips obtained in practice had a length of 20.5 mms, a breadth of 17.2 mms and a thickness of 3.4 mms.

For another chipper, the share of oversized chips was of the same order of magnitude when chipping wood having a dryness of about 56 percent, and also here the nominally set chip length was 19 mms. By a similar change of the chip guide, the share of oversized chips at maximum feed was reduced to 4.8 percent, the chips obtained having a length of 21.8 mms, a breadth of 19.2 mms and a thickness of 3.9 mms, whereas at a low feed rate the share of oversized chips was reduced to 1.7 percent, the chips obtained having a length of 19.4 mms, a breadth of 16.7 mms and a thickness of 3.3 mms. The share of undersized chips did not increase.

What is claimed is:

1. A wood chipper of the disk type for cuttng a chip slab from a log and causing the slab to disintegrate into chips comprising a chipper disk, means for rotating said disk about a central axis, said disk having at least one slot extending therethrough, an elongated cutter knife having inner and outer ends and having a cutting edge along one side, means for mounting said knife on said disk with said cutting edges positioned non-radially and substantially in alignment with said slot, the inner end of said knife being located adjacent to a central zone of said disk and the outer end being located adjacent to the periphery thereof, the inner end of said knife being disposed at an angle of substantially half a radian relative to a radius extending from said central axis, chip guide means in said slot generally parallel with said cutting edge and having one side disposed substantially in engagement with said knife and the opposite side remote therefrom, said chip guide means having a guiding surface which includes a plurality of ridges having rounded crests separated by grooves and extending side by side in a direction away from said knife and into said slot, the rotation of said disk and the angle of said knife and said guide means causing the chip slab to slide across said ridges so that the chip slab is broken into chips of substantially uniform size.

2. The invention of claim 1 in which said angle decreases toward the outer end of said knife.

3. The invention of claim 2 in which said angle is substantially 0.15 radian adjacent the outer end of said knife.

4. The invention of claim 1 including a plurality of slots extending through said disk, a cutter knife mounted in alignment with each slot, and said knives being disposed in a rotationally symmetrical configuration.

5. The invention of claim 1 in which said ridges are in substantial parallel relationship with one another at a relative spacing of approximately twice the intended chip breadth.

6. The invention of claim 1 in which the portion of each ridge located nearest the cutter knife increases in height above the grooves with increased spacing from said knife.

7. The invention of claim 1 in which said ridges have an included angle longitudinally of each ridge in the range of two to three radians depending upon the toughness of the wood to be cut into chips, the included angle decreasing with increasing toughness of the wood.

8. The invention of claim 1 in which the portion of each ridge remote from the cutter knife has a height above the grooves which gradually decreases to zero with increasing spacing from said knife.

9. The invention of claim 1 in which said grooves between said ridges have a concave smooth curvature in the longitudinal direction.

10. The invention of claim 1 including means for mounting said knife at an angle to the plane of rotation of said disk.

* * * * *